US008472653B2

(12) United States Patent
Kon

(10) Patent No.: US 8,472,653 B2
(45) Date of Patent: Jun. 25, 2013

(54) SOUND PROCESSING APPARATUS, SOUND IMAGE LOCALIZED POSITION ADJUSTMENT METHOD, VIDEO PROCESSING APPARATUS, AND VIDEO PROCESSING METHOD

(75) Inventor: Homare Kon, Tokyo (JP)

(73) Assignee: Sony Corporation, Tokyo (JP)

( * ) Notice: Subject to any disclaimer, the term of this patent is extended or adjusted under 35 U.S.C. 154(b) by 424 days.

(21) Appl. No.: 12/545,956

(22) Filed: Aug. 24, 2009

(65) Prior Publication Data

US 2010/0053210 A1 Mar. 4, 2010

(30) Foreign Application Priority Data

Aug. 26, 2008 (JP) ..... 2008-216120

(51) Int. Cl.
*H04R 5/02* (2006.01)

(52) U.S. Cl.
USPC ..... 381/310; 381/304; 381/309; 381/17

(58) Field of Classification Search
USPC ..... 381/309, 310, 1, 19, 92, 28, 17, 18, 381/7, 12, 61, 300, 303, 304, 305, 20, 74; 73/1.77, 861.354, 503.3, 504.02, 504.08, 73/504.18, 862.192, 514.01, 514.02; 348/208.2, 348/208.4, 208.8, 208.13, 208.14, 50, 94, 348/116, 143, 154, 155, 169, 170, 171, 172; 386/223, 227, 234, 242, 320, 341; 345/110, 345/953, 8; 700/94
See application file for complete search history.

(56) References Cited

U.S. PATENT DOCUMENTS

| | | | | |
|---|---|---|---|---|
| 5,687,239 | A * | 11/1997 | Inanaga et al. | 381/309 |
| 2002/0025054 | A1 * | 2/2002 | Yamada et al. | 381/310 |
| 2002/0164037 | A1 * | 11/2002 | Sekine | 381/18 |
| 2004/0196991 | A1 * | 10/2004 | Iida et al. | 381/309 |
| 2008/0008342 | A1 | 1/2008 | Sauk | |

FOREIGN PATENT DOCUMENTS

| | | | |
|---|---|---|---|
| JP | 1-120999 | A | 5/1989 |
| JP | 6-047170 | A | 2/1994 |
| JP | 8-237790 | A | 9/1996 |
| JP | 10-098798 | A | 4/1998 |
| JP | 11-205892 | | 7/1999 |
| JP | 2002-044800 | A | 2/2002 |
| JP | 3422026 | | 4/2003 |
| JP | 2009-543479 | A | 12/2009 |

* cited by examiner

*Primary Examiner* — Vivian Chin
*Assistant Examiner* — Leshui Zhang
(74) *Attorney, Agent, or Firm* — Wolf, Greenfield & Sacks, P.C.

(57) ABSTRACT

A sound processing apparatus includes: sound image localization processing means for performing a sound image localization process on a sound signal to be reproduced; a speaker section placeable over an ear of a user and supplied with the sound signal to emit sound in accordance with the sound signal; turning detection means provided in the speaker section to detect turning of the head of the user; inclination detection means provided in the speaker section to detect inclination of the turning detection means; turning correction means for correcting detection results from the turning detection means on the basis of detection results of the inclination detection means; and adjustment means for controlling the sound image localization processing means so as to adjust the localized position of a sound image on the basis of the detection results from the turning detection means corrected by the turning correction means.

18 Claims, 8 Drawing Sheets

OUTPUT OF GYRO SENSOR IN IDEAL STATE: Si

ACTUAL OUTPUT OF GYRO SENSOR: Sr $$Sr = Si \cdot \cos\theta \cdot \cos\phi \quad \cdots (1)$$

ESTIMATED OUTPUT VALUE OF GYRO SENSOR IN IDEAL STATE: Sii $$Sii = Sr/(\cos\theta \cdot \cos\phi) \quad \cdots (2)$$

SOUND PROCESSING APPARATUS, SOUND IMAGE LOCALIZED POSITION ADJUSTMENT METHOD, VIDEO PROCESSING APPARATUS, AND VIDEO PROCESSING METHOD

BACKGROUND OF THE INVENTION

1. Field of the Invention

The present invention relates to an apparatus for processing sound and video in which adjustment is performed in accordance with turning of the head of a user by using a sound image localization process, a process for adjusting a video clipping angle or the like, and also to a method for use in the apparatus.

2. Description of the Related Art

Sound signals accompanying a video such as a movie are recorded on the assumption that the sound signals are to be reproduced by speakers installed on both sides of a screen. In such setting, the positions of sound sources in the video coincide with the positions of sound images actually heard, forming a natural sound field.

When the sound signals are reproduced using headphones or earphones, however, the sound images are localized in the head and the directions of the visual images do not coincide with the localized positions of the sound images, making the localization of the sound images extremely unnatural.

This is also the case when music accompanied by no video is listened to. In this case, music being played is heard from inside the head unlike the case where the music is reproduced by speakers, also making the sound field unnatural.

As a scheme for hindering reproduced sound from being localized in the head, a method for producing a virtual sound image by head-related transfer functions (HRTF) is known.

FIGS. 8 to 11 illustrate the outline of a virtual sound image localization process performed by the HRTFs. The following describes a case where the virtual sound image localization process is applied to a headphone system with two left and right channels.

As shown in FIG. 8, the headphone system of this example includes a left-channel sound input terminal 101L and a right-channel sound input terminal 101R.

As stages subsequent to the sound input terminals 101L, 101R, a signal processing section 102, a left-channel digital/analog (D/A) converter 103L, a right-channel D/A converter 103R, a left-channel amplifier 104L, a right-channel amplifier 104R, a left headphone speaker 105L, and a right headphone speaker 105R are provided.

Digital sound signals input through the sound input terminals 101L, 101R are supplied to the signal processing section 102, which performs a virtual sound image localization process for localizing a sound image produced from the sound signals at an arbitrary position.

After being subjected to the virtual sound image localization process in the signal processing section 102, the left and right digital sound signals are converted into analog sound signals in the D/A converters 103L, 103R. After being converted into analog sound signals, the left and right sound signals are amplified in the amplifiers 104L, 104R, and thereafter supplied to the headphone speakers 105L, 105R. Consequently, the headphone speakers 105L, 105R emit sound in accordance with the sound signals in the two left and right channels that have been subjected to the virtual sound image localization process.

A head band 110 for allowing the left and right headphone speakers 105L, 105R to be placed over the head of a user is provided with a gyro sensor 106 for detecting turning of the head of the user as described later.

A detection output from the gyro sensor 106 is supplied to a detection section 107, which detects an angular speed when the user turns his/her head. The angular speed from the detection section 107 is converted by an analog/digital (A/D) converter 108 into a digital signal, which is thereafter supplied to a calculation section 109. The calculation section 109 calculates a correction value for the HRTFs in accordance with the angular speed during the turning of the head of the user. The correction value is supplied to the signal processing section 102 to correct the localization of the virtual sound image.

By detecting turning of the head of the user using the gyro sensor 106 in this way, it is possible to localize the virtual sound image at a predetermined position at all times in accordance with the orientation of the head of the user.

That is, the virtual sound image is not localized in front of the user but remains localized at the original position even if the user turns his/her head.

The signal processing section 102 shown in FIG. 8 applies transfer characteristics equivalent to transfer functions HLL, HLR, HRR, HRL from two speakers SL, SR installed in front of a listener M to both ears YL, YR of the listener M as shown in FIG. 9.

The transfer function HLL corresponds to transfer characteristics from the speaker SL to the left ear YL of the listener M. The transfer function HLR corresponds to transfer characteristics from the speaker SL to the right ear YR of the listener M. The transfer function HRR corresponds to transfer characteristics from the speaker SR to the right ear YR of the listener M. The transfer function HRL corresponds to transfer characteristics from the speaker SR to the left ear YL of the listener M.

The transfer functions HLL, HLR, HRR, HRL may be obtained as an impulse response on the time axis. By implementing the impulse response in the signal processing section 102 shown in FIG. 8, it is possible to regenerate a sound image equivalent to a sound image produced by the speakers SL, SR installed in front of the listener M as shown in FIG. 9 when reproduced sound is heard with headphones.

As discussed above, the process for applying the transfer functions HLL, HLR, HRR, HRL to the sound signals to be processed is implemented by finite impulse response (FIR) filters provided in the signal processing section 102 of the headphone system shown in FIG. 8.

The signal processing section 102 shown in FIG. 8 is specifically configured as shown in FIG. 10. For the sound signal input through the left-channel sound input terminal 101L, an FIR filter 1021 for implementing the transfer function HLL and an FIR filter 1022 for implementing the transfer function HLR are provided.

Meanwhile, for the sound signal input through the right-channel sound input terminal 101R, an FIR filter 1023 for implementing the transfer function HRL and an FIR filter 1024 for implementing the transfer function HRR are provided.

An output signal from the FIR filter 1021 and an output signal from the FIR filter 1023 are added by an adder 1025, and supplied to the left headphone speaker 105L. Meanwhile, an output signal from the FIR filter 1024 and an output signal from the FIR filter 1022 are added by an adder 1026, and supplied to the right headphone speaker 105R.

The thus configured signal processing section 102 applies the transfer functions HLL, HLR to the left-channel sound signal, and applies the transfer functions HRL, HRR to the right-channel sound signal.

By using the detection output from the gyro sensor 106 provided in the head band 110, it is possible to keep the virtual sound image localized at a fixed position even if the user turns his/her head, allowing produced sound to form a natural sound field.

In the foregoing, a description has been made of a case where the virtual sound image localization process is performed on the sound signals in the two left and right channels. However, the sound signals to be processed are not limited to sound signals in the two left and right channels. Japanese Unexamined Patent Application Publication No. Hei 11-205892 describes in detail an audio reproduction apparatus adapted to perform a virtual sound image localization process on sound signals in a multiplicity of channels.

SUMMARY OF THE INVENTION

In the related-art headphone system for performing the virtual sound image localization process illustrated in FIGS. 8 to 10, the gyro sensor 106 detects turning of the head of the user, and may be a one-axis gyro sensor, for example. In the related-art headphone system, the gyro sensor 106 may be provided in the headphones with the detection axis extending in the vertical direction (the direction of gravitational force).

That is, as shown in FIG. 11, the gyro sensor 106 may be fixed at a predetermined position in the head band 110 for placing the left and right headphone speakers 105L, 105R over the head of the user. Consequently, it is possible to maintain the detection axis of the gyro sensor 106 to extend in the vertical direction with the headphone system placed over the head of the user.

However, this approach may not be applied as it is to earphones and headphones with no head band, such as earphones of so-called in-ear type and intra-concha type with earpieces insertable into the ear capsules of the user and headphones of so-called ear-hook type with speakers hookable on the ear capsules of the user.

The shape of the ears and the manner of wearing earphones or headphones vary between users. Therefore, it is practically difficult to provide the gyro sensor 106 in the earphones of in-ear type or intra-concha type or the headphones of ear-hook type with the detection axis extending in the vertical direction when such earphones or headphones are placed over the ears of the user.

A similar phenomenon occurs in a system that uses a small display device mountable over the head of the user called "head-mounted display", for example, in which an image for display is changed in response to turning of the head of the user.

That is, when turning of the head of the user is not detected accurately, the head-mounted display may not be able to display an appropriate image in accordance with the orientation of the head of the user.

In view of the above, it is desirable to provide an apparatus capable of appropriately detecting turning of the head of a user to perform appropriate adjustment in accordance with the turning of the head of the user.

According to a first embodiment of the present invention, there is provided a sound processing apparatus including: sound image localization processing means for performing a sound image localization process on a sound signal to be reproduced in accordance with a predefined head-related transfer function; a speaker section placeable over an ear of a user and supplied with the sound signal which has been subjected to the sound image localization process by the sound image localization processing means to emit sound in accordance with the sound signal; turning detection means provided in the speaker section to detect turning of a head of the user wearing the speaker section; inclination detection means provided in the speaker section to detect inclination of the turning detection means; turning correction means for correcting detection results from the turning detection means on the basis of detection results of the inclination detection means; and adjustment means for controlling the sound image localization processing means so as to adjust a localized position of a sound image on the basis of the detection results from the turning detection means corrected by the turning correction means.

With the sound processing apparatus according to the first embodiment of the present invention, the turning detection means provided in the speaker section placed over an ear of a user detects turning of the head of the user, and the inclination detection means provided in the speaker section detects inclination of the turning detection means.

The turning correction means corrects the detection output from the turning detection means on the basis of the inclination of the turning detection means obtained from the inclination detection means. The sound image localization process to be performed by the sound image localization processing means is controlled so as to adjust the localized position of a sound image on the basis of the corrected detection output from the turning detection means.

Consequently, it is possible to appropriately detect turning of the head of the user, appropriately control the sound image localization process to be performed by the sound image localization processing means, and properly adjust the localized position of a sound image.

DESCRIPTION OF THE PREFERRED EMBODIMENTS

An embodiment of the present invention will be described below with reference to the drawings.

<First Embodiment>

In principle, the present invention is applicable to multichannel sound processing apparatuses. In the first embodiment described below, however, a description is made of a case where the present invention is applied to a sound processing apparatus with two left and right channels for ease of description.

Figure 1:
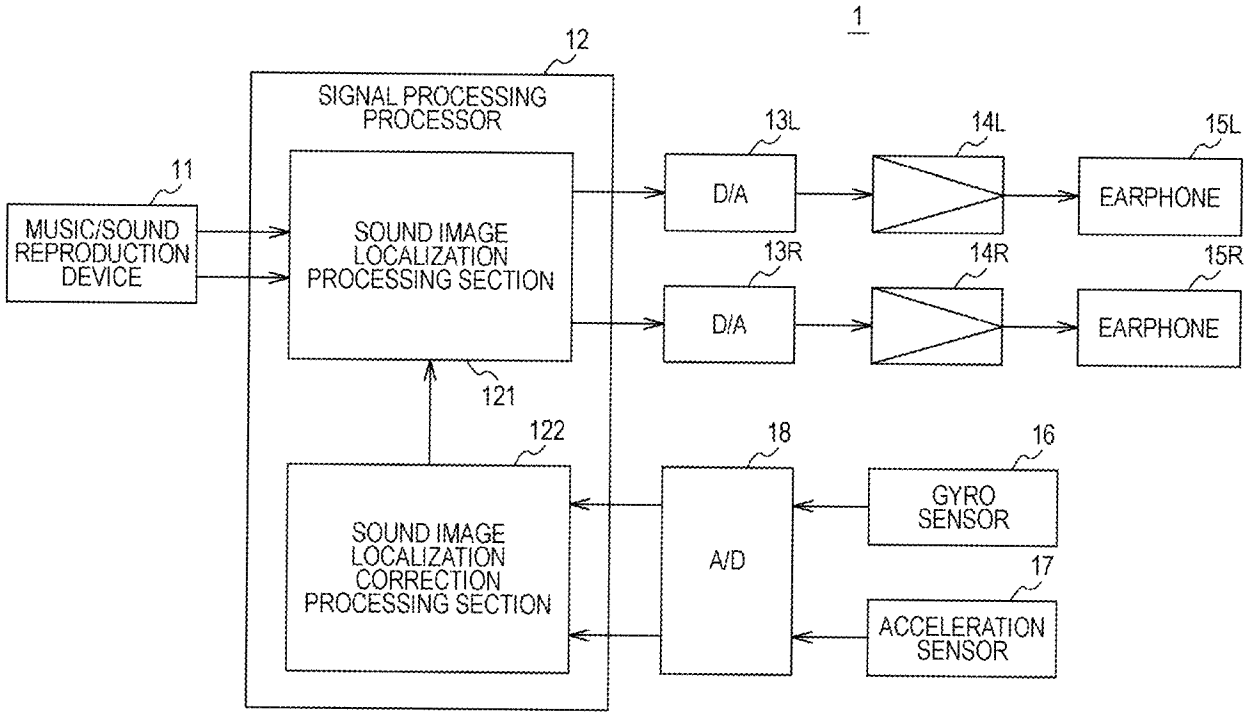
FIG. 1 is a block diagram illustrating an exemplary configuration of an earphone system of a sound processing apparatus according to a first embodiment of the present invention.

FIG. 1 is a block diagram illustrating an exemplary configuration of an earphone system 1 according to a first embodiment. The earphone system 1 shown in FIG. 1 is roughly divided into a system for reproducing a sound signal and a system for detecting and correcting turning of a user's head.

The system for reproducing a sound signal is composed of a music/sound reproduction device 11, a sound image localization processing section 121 of a signal processing processor 12, digital/analog (D/A) converters 13L, 13R, amplifiers 14L, 14R, and earphones 15L, 15R.

The D/A converter 13L, the amplifier 14L, and the earphone 15L are used for the left channel. The D/A converter 13R, the amplifier 14R, and the earphone 15R are used for the right channel.

The system for detecting and correcting turning of a user's head is composed of a gyro sensor 16, an acceleration sensor 17, an analog/digital (A/D) converter 18, and a sound image localization correction processing section 122 of the signal processing processor 12.

The music/sound reproduction device 11 may be a reproduction device of any of various types including integrated-circuit (IC) recorders that use a semiconductor as a storage medium, cellular phone terminals with a music playback function, and devices for playing a small optical disk such as a CD (Compact Disc) or an MD (registered trademark).

The earphones 15L, 15R may be of in-ear type, intra-concha type, or ear-hook type. That is, the earphones 15L, 15R may take various positions when they are placed over the ears of the user depending on the shape of the ears and the manner of wearing the earphones of the user.

The gyro sensor 16 and the acceleration sensor 17 may be provided in one of the earphones 15L, 15R, and are provided in the earphone 15L for the left channel in the first embodiment as described later.

In the earphone system 1 shown in FIG. 1, digital sound signals reproduced by the music/sound reproduction device 11 are supplied to the sound image localization processing section 121 of the signal processing processor 12.

Figure 10:
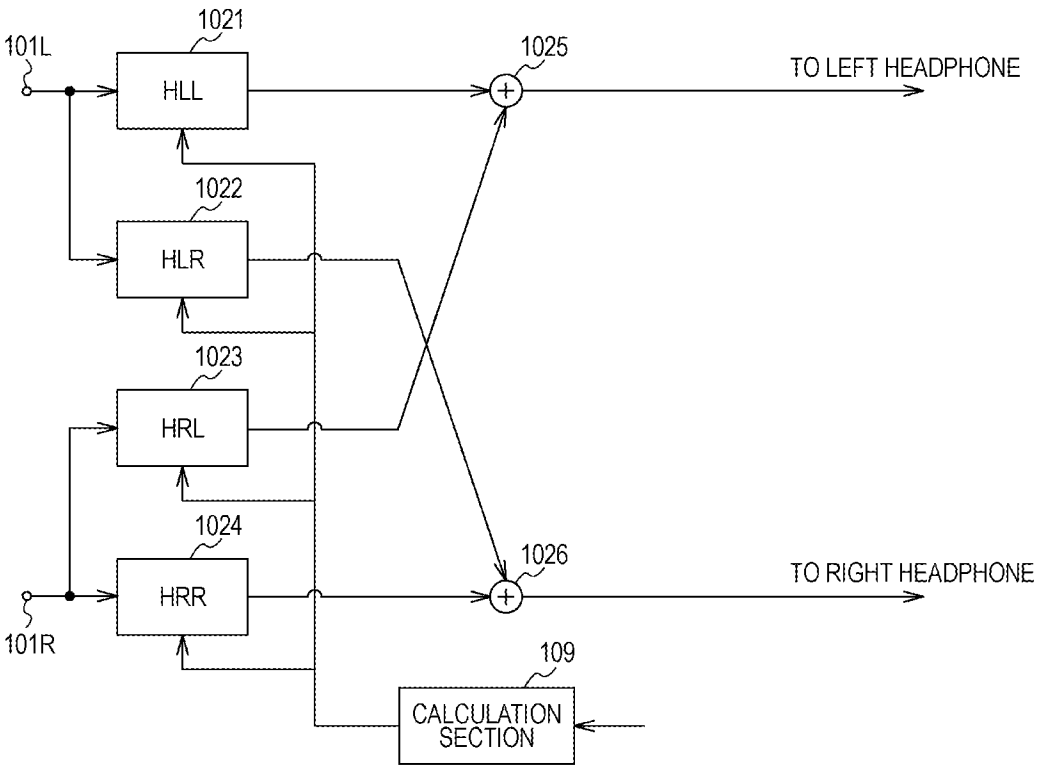
FIG. 10 illustrates an exemplary configuration of a signal processing section shown in FIG. 8.
Figure 11B:
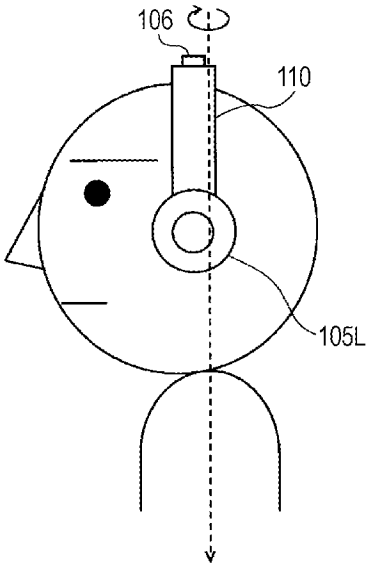
FIG. 11B illustrates a case where the related-art headphone system provided with the gyro sensor is placed over the head of the user as the user is viewed from the left.
Figure 11A:
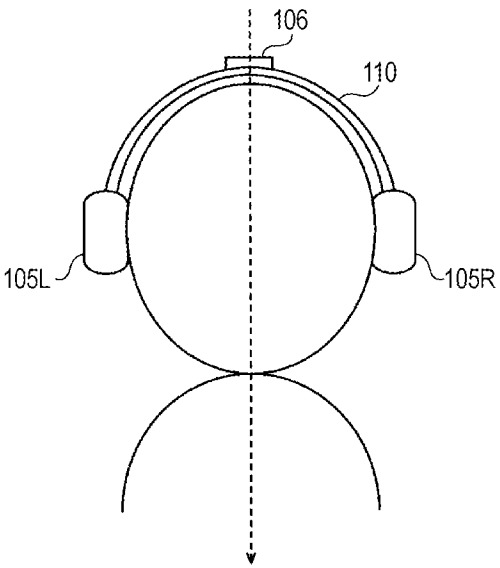
FIG. 11A illustrates a case where a related-art headphone system provided with a gyro sensor is placed over the head of a user as the user is viewed from the back.

The sound image localization processing section 121 may be configured as illustrated in FIG. 10, for example. That is, the sound image localization processing section 121 may include four finite impulse response (FIR) filters 1021, 1022, 1023, 1024 for implementing transfer functions HLL, HLR, HRL, HRR, respectively, and two adders 1025, 1026 as illustrated in FIG. 10.

The respective transfer functions of the FIR filters 1021, 1022, 1023, 1024 of the sound image localization processing section 121 are correctable in accordance with correction information from the sound image localization correction processing section 122 described below.

As shown in FIG. 1, a detection output from the gyro sensor 16 and a detection output from the acceleration sensor 17 are converted into digital signals by the A/D converter 18, and then supplied to the sound image localization correction processing section 122 of the earphone system 1 according to the first embodiment.

As discussed above, the gyro sensor 16 and the acceleration sensor 17 are provided in the earphone 15L for the left channel.

The gyro sensor 16 detects horizontal turning of the head of the user wearing the earphone 15L over the ear, and may be a one-axis gyro sensor, for example. The acceleration sensor 17 may be a three-axis acceleration sensor, which detects inclination of the gyro sensor 16 by detecting accelerations in the directions of the three axes which are perpendicular to each other.

In order to accurately detect horizontal turning of the head of the user, it is necessary to place the earphone 15L over the ear of the user such that the detection axis of the gyro sensor 16 extends in the vertical direction.

As discussed above, the earphones 15L, 15R are of in-ear type, intra-concha type, or ear-hook type. Therefore, it is often difficult to place the earphone 15L over the ear of the user with the detection axis of the gyro sensor 16 provided in the earphone 15L extending in the vertical direction (in other words, with the detection axis extending perpendicularly to the floor surface).

Accordingly, the sound image localization correction processing section 122 uses the detection output of the three-axis acceleration sensor 17 also provided in the earphone 15L to detect the inclination of the gyro sensor 16. The sound image localization correction processing section 122 then corrects the detection output of the gyro sensor 16 on the basis of the detection output of the acceleration sensor 17 to accurately detect horizontal turning of the head of the user (in terms of orientation and amount).

The sound image localization correction processing section 122 corrects the transfer functions of the respective FIR filters of the sound image localization processing section 121 in accordance with the accurately detected turning of the head of the user so that a sound image localization process may be performed appropriately.

Consequently, even if the user wearing the earphones 15L, 15R over the ears turns his/her head horizontally to change the orientation of his/her head, the localized position of a sound image does not change but it remains localized at the original position.

In the case where the user is listening to sound emitted from the speakers installed in a room, the emitted sound comes from the speakers because the positions of the speakers do not change even if the user changes the orientation of his/her head.

In the case of an earphone system employing a virtual sound image localization process for localizing a sound image in front of the user, however, the sound image is localized in front of the user at all times as the user changes the orientation of his/her head.

That is, in the case of an earphone system employing a virtual sound image localization process, the localized position of a sound image moves as the user wearing the earphones changes the orientation of his/her head, making the sound field unnatural.

Accordingly, the virtual sound image localization process may be corrected appropriately in accordance with horizontal turning of the head of the user by means of the functions of the sound image localization correction processing section 122 and so forth as discussed above, keeping a sound image localized at a fixed position at all times and forming a natural sound field.

Figure 2B:
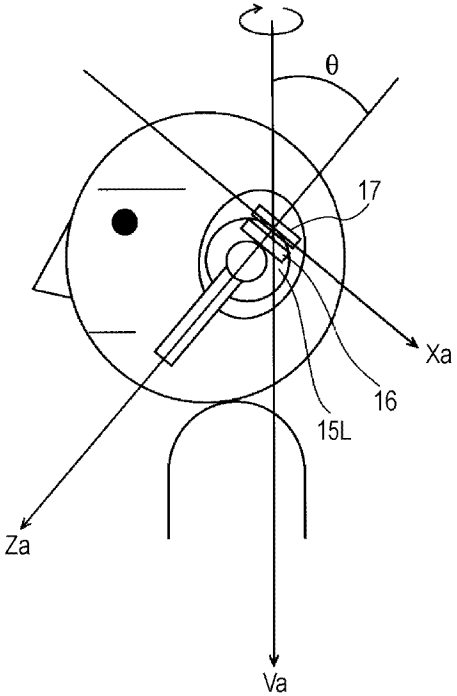
FIG. 2B illustrates the relationship between the detection axis of the gyro sensor and the detection axes of the acceleration sensor with the earphones placed over the ears of the user as the user is viewed from the left.
Figure 2A:
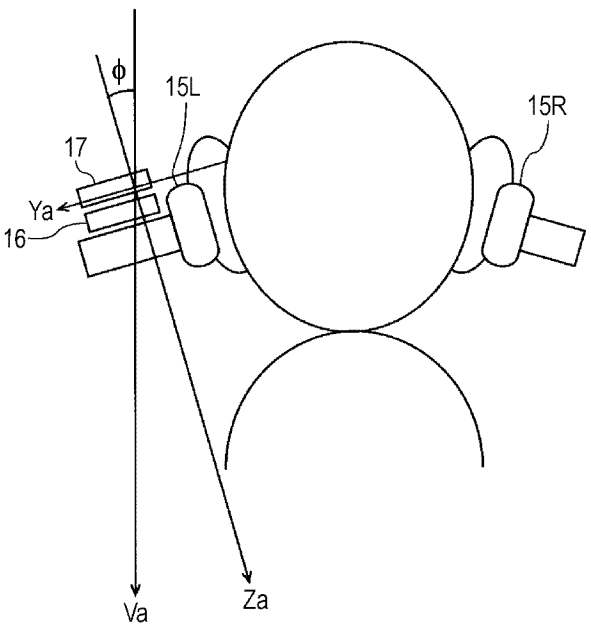
FIG. 2A illustrates the relationship between the detection axis of a gyro sensor and the detection axes of an acceleration sensor with earphones placed over the ears of a user as the user is viewed from the back.

The following specifically describes a process to be performed in the sound image localization correction processing section 122. FIGS. 2A and 2B illustrate the relationship between the detection axis of the gyro sensor 16 and the detection axes of the acceleration sensor 17 with the earphones 15L, 15R placed over the ears of the user. FIG. 2A shows the user wearing the earphones 15L, 15R as viewed from the back. FIG. 2B shows the user wearing the earphone 15L as viewed from the left.

In FIGS. 2A and 2B, the axes Xa, Ya, Za are the three detection axes of the acceleration sensor 17 which are perpendicular to each other. The vertical axis Va corresponds to the vertical direction (the direction of gravitational force), and extends in the direction perpendicular to the floor surface.

The acceleration sensor 17 is provided in a predefined positional relationship with the gyro sensor 16 so as to be able to detect the inclination of the gyro sensor 16. In the earphone system 1 according to the first embodiment, the acceleration sensor 17 is provided with the Za axis, of the three axes, matching the detection axis of the gyro sensor 16.

As discussed above, the earphones 15L, 15R of the earphone system 1 are of in-ear type, intra-concha type, or earhook type. Therefore, as shown in FIG. 2A, the earphones 15L, 15R are separately placed over the left and right ears, respectively, of the user.

A case is considered where the detection axis of the gyro sensor 16, which matches the Za axis of the acceleration sensor 17, does not agree with the vertical direction, which is indicated by the vertical axis Va, as shown in FIG. 2A, which shows the user as viewed from the back.

In this case, the amount of deviation of the detection axis of the gyro sensor 16 from the vertical direction is defined as $\phi$ degrees as shown in FIG. 2A. That is, the amount of deviation of the detection axis of the gyro sensor 16 from the vertical direction in the plane defined by the Ya axis and Za axis, which are the detection axes of the acceleration sensor 17, is $\phi$ degrees.

When the user in this case is viewed from the left, the amount of deviation of the detection axis of the gyro sensor 16, which matches the Za axis of the acceleration sensor 17, from the vertical direction, which is indicated by the vertical axis Va, is $\theta$ degrees as shown in FIG. 2B.

Figures 3, 4:
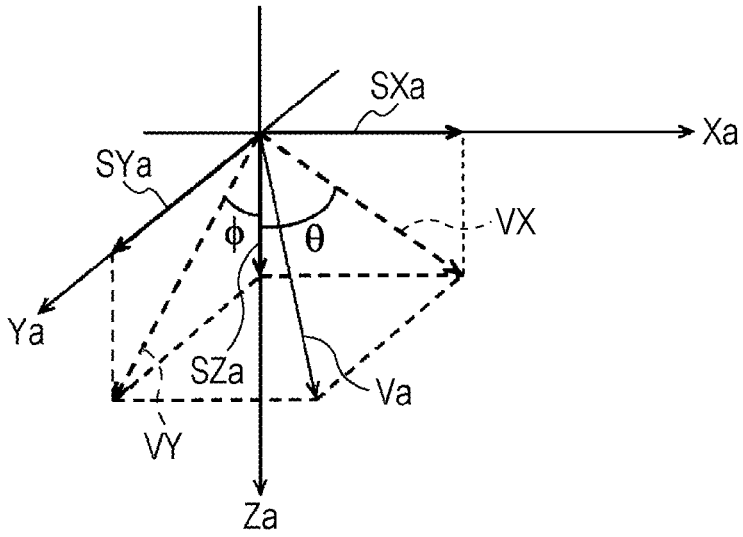
FIG. 3 illustrates the deviation between the detection axis of the gyro sensor and the vertical direction in a coordinate system defined by the three detection axes Xa, Ya, Za of the acceleration sensor.
FIG. 4 shows formulas illustrating a correction process performed by a sound image localization correction processing section.

The relationship between the detection axis of the gyro sensor 16, the three detection axes of the acceleration sensor 17, and the vertical direction shown in FIGS. 2A and 2B is summarized below. FIG. 3 illustrates the deviation between the detection axis of the gyro sensor 16 and the vertical direction in a coordinate system defined by the three detection axes Xa, Ya, Za of the acceleration sensor 17.

In FIG. 3, the arrow SXa on the Xa axis corresponds to the detection output of the acceleration sensor 17 in the Xa-axis direction, the arrow SYa on the Ya axis corresponds to the detection output of the acceleration sensor 17 in the Ya-axis direction, and the arrow SZa on the Za axis corresponds to the detection output of the acceleration sensor 17 in the Za-axis direction.

In FIG. 3, the vertical axis Va, which is indicated by the solid arrow, corresponds to the actual vertical direction of the three-axis coordinate system shown in FIG. 3. As discussed above, the acceleration sensor 17 is provided with the Za axis, which is one of the detection axes, matching the detection axis of the gyro sensor 16.

Thus, the vertical direction in the Ya-Za plane, which is defined by the Ya axis and the Za axis of the acceleration sensor 17, corresponds to the direction indicated by the dotted arrow VY in FIG. 3. Hence, the deviation between the vertical direction VY and the detection axis of the gyro sensor 16 in the Ya-Za plane (which corresponds to the Za axis) is known to be an angle of $\phi$ degrees formed between the vertical direction VY and the Za axis. The state shown in the Ya-Za plane corresponds to the state shown in FIG. 2A.

Meanwhile, the vertical direction in the Xa-Za plane, which is defined by the Xa axis and the Za axis of the acceleration sensor 17, corresponds to the direction indicated by the dotted arrow VY in FIG. 3. Hence, the deviation between the vertical direction VX and the detection axis of the gyro sensor 16 in the Xa-Za plane (which corresponds to the Za axis) is known to be an angle of $\theta$ degrees formed between the vertical direction VX and the Za axis. The state shown in the Xa-Za plane corresponds to the state shown in FIG. 2B.

Then, as is shown in FIG. 3, the amount of deviation of the detection axis of the gyro sensor 16 from the vertical direction in the Xa-Za plane is defined as ($\cos\theta$). Likewise, the amount of deviation of the detection axis of the gyro sensor 16 from the vertical direction in the Ya-Za plane is defined as ($\cos\phi$).

FIG. 4 shows formulas illustrating a correction process performed by the sound image localization correction processing section 122.

The output of the gyro sensor 16 in the ideal state, that is, the detection output of the gyro sensor 16 with the detection axis of the gyro sensor 16 matching the actual vertical direction, is denoted as "Si".

The actual output of the gyro sensor 16, that is, the detection output of the gyro sensor 16 with the detection axis of the gyro sensor 16 deviating from the vertical direction by $\phi$ degrees in the Ya-Za plane and $\phi$ degrees in the Xa-Za plane, is denoted as "Sr".

In this case, the actual detection output "Sr" is obtained by multiplying the detection output in the ideal state "Si", the amount of deviation in the Xa-Za plane ($\cos\theta$), and the amount of deviation in the Ya-Za plane ($\cos\phi$) as expressed by the formula (1) in FIG. 4.

The estimated output value of the gyro sensor 16 in the ideal state is denoted as "Sii". The estimated output value "Sii" and the output value of the gyro sensor 16 in the ideal state "Si" should in principle be as close as possible to each other.

Thus, the estimated output value of the gyro sensor 16 in the ideal state "Sii" is obtained by the formula (2) in FIG. 4. That is, the estimated output value "Sii" is obtained by dividing the actual output value of the gyro sensor 16 "Sr" by a value obtained by multiplying the amount of deviation in the Xa-Za plane ($\cos\theta$) and the amount of deviation in the Ya-Za plane ($\cos\phi$).

The sound image localization correction processing section 122 is supplied with the detection output from the gyro sensor 16 and the detection output from the acceleration sensor 17. The sound image localization correction processing section 122 obtains the amount of deviation of the detection axis of the gyro sensor 16 from the vertical direction on the basis of the detection outputs for the three axes of the acceleration sensor 17 as illustrated in FIGS. 2 and 3, and corrects the detection output of the gyro sensor 16 on the basis of the obtained amount of deviation in accordance with the formula (2) in FIG. 4.

The sound image localization correction processing section 122 corrects the respective transfer functions of the FIR filters of the sound image localization processing section 121 on the basis of the corrected detection output of the gyro sensor 16 in order to appropriately correct the localized position of a virtual sound image in accordance with turning of the head of the user.

The acceleration sensor 17 is a three-axis acceleration sensor as discussed above, and it is possible to obtain the values of tan θ and tan ϕ from the output values for the two axes forming the corresponding plane. Arctangents (arctans) of these values are obtained to obtain the values of θand ϕ.

In other words, in the state shown in FIG. 3, θ is obtained as arctan(SZa/SXa). Likewise, ϕ is obtained as arctan(SZa/SYa).

Consequently, cos θ and cos ϕ are obtained on the basis of the detection output of the acceleration sensor 17. Then, the detection output of the gyro sensor 16 may be corrected using cos θ and cos ϕ in accordance with the formula (2) in FIG. 4.

As described above, even in the case where the detection axis of the gyro sensor 16 does not extend in the vertical direction with the earphone 15L placed over the ear of the user, it is possible to make appropriate corrections using the detection output of the acceleration sensor 17 provided in fixed positional relationship with the gyro sensor 16.

This allows the virtual sound image localization process performed in the sound image localization processing section 121 to be corrected appropriately in accordance with horizontal turning of the head of the user, keeping a sound image localized at a fixed position at all times and forming a natural sound field.

In the earphone system 1 according to the first embodiment, the sound image localization process with consideration of horizontal turning of the head of the user is performed when a predetermined operation button switch of the earphone system 1 is operated. In this case, the position of the head of the user at the time when the predetermined operation button switch is operated is employed as the position with the head of the user directed forward (reference position).

Alternatively, the position with the head of the user directed forward (reference position) may be determined as the position of the head of the user at the time when a music playback button is operated, for example, before starting the sound image localization process with consideration of turning of the head of the user.

Still alternatively, when it is detected that the user shakes his/her head in great motion and that the motion of his/her head comes to a halt, the position of the head of the user at that moment may be determined as the position with the head of the user directed forward (reference position), for example, before starting the sound image localization process with consideration of turning of the head of the user.

Various other triggers detectable by the earphone system 1 may be used to start the sound image localization process with consideration of turning of the head of the user.

Moreover, as understood from the above description, it is possible to detect the deviation of the detection axis of the gyro sensor 16 from the vertical direction using the detection output of the acceleration sensor 17 even if the head of the user wearing the earphones 15L, 15R is inclined, for example.

Thus, it is possible to appropriately correct the detection output of the gyro sensor 16 on the basis of the detection output of the acceleration sensor 17 even if the head of the user is inclined.

[Modifications of First Embodiment]

Although the acceleration sensor 17 is of a three-axis acceleration sensor in the earphone system 1 according to the first embodiment discussed above, the present invention is not limited thereto. The acceleration sensor 17 may be of a one-axis or two-axis acceleration sensor.

For example, a one-axis acceleration sensor is initially disposed with the detection axis extending in the vertical direction. It is then possible to detect the deviation of the detection axis of the gyro sensor from the vertical direction in accordance with the differential between the actual detection value of the one-axis acceleration sensor and the value in the initial state (9.8 $m/s^2$).

A two-axis acceleration sensor may also be used in the same way. That is, also in the case of a two-axis acceleration sensor, it is possible to detect the deviation of the detection axis of the gyro sensor from the vertical direction in accordance with the differential between the actual detection output of the acceleration sensor and the detection output obtained with the acceleration sensor disposed horizontally with respect to the floor surface.

A multiplicity or users may use an earphone system equipped with a gyro sensor and a one-axis or two-axis acceleration sensor to measure the detection output of the acceleration sensor and the amount of deviation of the detection axis of the gyro sensor in advance, preparing a table in which the resulting measurement values are correlated.

Then, the detection output of the acceleration sensor may be referenced in the table to specify the amount of deviation of the detection axis of the gyro sensor from the vertical direction, on the basis of which the detection output of the gyro sensor may be corrected.

In this case, it is necessary to store the table in which the detection output of the acceleration sensor and the amount of deviation of the detection axis of the gyro sensor from the vertical direction are correlated in a memory in the sound image localization correction processing section 122 or an accessible external memory, for example.

Although the gyro sensor 16 is a one-axis gyro sensor in the above description, the present invention is not limited thereto. A gyro sensor with two or more axes may also be used. Also in this case, it is possible to detect turning of the head of the user in the vertical direction (up-and-down direction), allowing correction of the localization of a sound image in the vertical direction, for example.

As discussed above, the present invention is suitably applicable to earphones and headphones of in-ear type, intra-concha type, and ear-hook type. However, the present invention is also applicable to traditional headphones having a head band.

In the first embodiment, as is clear from the above description, the sound image localization processing section 121 implements the function as sound image localization processing means, and the earphone 15L implements the function as a speaker section. In addition, the gyro sensor 16 implements the function as turning detection means, the acceleration sensor 17 implements the function as inclination detection means, and the sound image localization correction processing section 122 implements the function as turning correction means and the function as adjustment means.

The earphone system according to the first embodiment illustrated in FIGS. 1 to 4 is applied with a sound image localized position adjustment method according to the present invention. That is, the sound image localized position adjustment method according to the present invention includes the steps of: (1) detecting turning of the head of the user wearing the earphone 15L through the gyro sensor 16 provided in the earphone 15L; (2) detecting inclination of the gyro sensor 16 through the acceleration sensor 17 provided in the earphone 15L; (3) correcting the detection results for the turning of the head of the user detected by the gyro sensor 16 on the basis of the inclination of the gyro sensor 16 detected by the acceleration sensor 17; and (4) controlling the sound image localization process to be performed on the sound signal to be reproduced to adjust the localized position of a sound image on the basis of the corrected detection results for the turning of the head of the user detected by the gyro sensor 16.

<Second Embodiment>

Now, a description is made of a case where the present invention is applied to a video processing apparatus that uses a small display device mountable over the head of a user or the so-called "head-mounted display".

Figure 5:
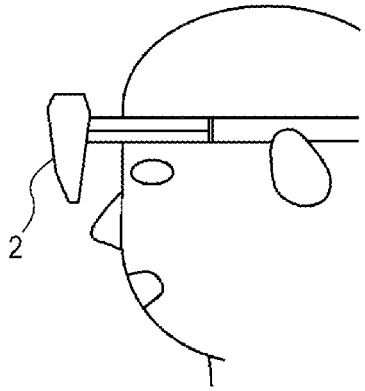
FIG. 5 illustrates the appearance of a head-mounted display section of a video processing apparatus according to a second embodiment of the present invention.
Figure 6:
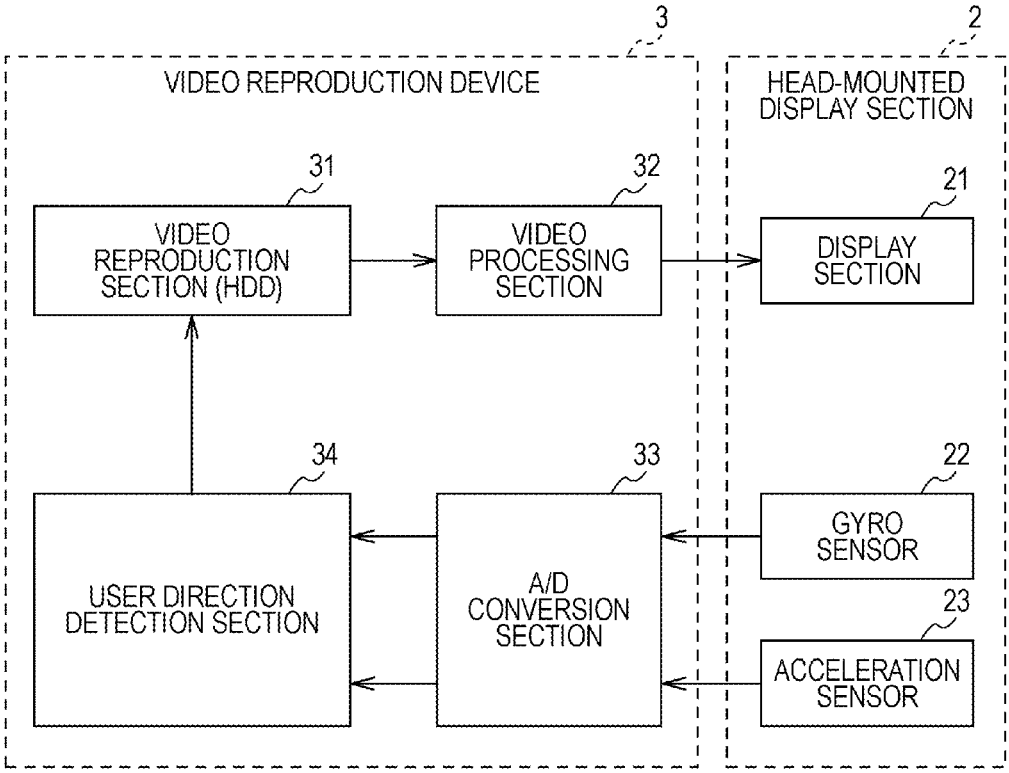
FIG. 6 is a block diagram illustrating an exemplary configuration of the video processing apparatus including the head-mounted display section according to the second embodiment.

FIG. 5 illustrates the appearance of a head-mounted display section 2 used in the second embodiment of the present invention. FIG. 6 is a block diagram illustrating an exemplary configuration of the video processing apparatus including the head-mounted display section 2 according to the second embodiment.

As shown in FIG. 5, the head-mounted display section 2 is utilized as mounted over the head of the user with a small screen positioned several centimeters away from the eyes of the user.

The head-mounted display section 2 may be configured to form and display an image on the screen positioned in front of the eyes of the user as if the image were a certain distance away from the user.

A video reproduction device 3, which is a component of the video processing apparatus according to this embodiment which uses the head-mounted display section 2, stores moving image data captured for an angular range wider than the human viewing angle, for example, in a hard disk drive as discussed later. Specifically, moving image data captured for a range of 360 degrees in the horizontal direction are stored in the hard disk drive. Horizontal turning of the head of the user wearing the head-mounted display section 2 is detected to display a section of the video in accordance with the orientation of the head of the user.

For this purpose, as shown in FIG. 6, the head-mounted display section 2 includes a display section 21 which may be a liquid crystal display (LCD), for example, a gyro sensor 22 for detecting turning of the head of the user, and an acceleration sensor 23.

The video reproduction device 3 supplies the head-mounted display section 2 with a video signal, and may be a video reproduction device of various types including hard disk recorders and video game consoles.

As shown in FIG. 6, the video reproduction device 3 of the video processing apparatus according to the second embodiment includes a video reproduction section 31 with a hard disk drive (hereinafter simply referred to as "HDD"), and a video processing section 32.

The video reproduction device 3 further includes an A/D converter 33 for receiving the detection outputs from the sensors of the head-mounted display section 2, and a user direction detection section 34 for detecting the orientation of the head of the user.

In general, the video reproduction device 3 receives from the user a command for which video content the user selects to play, and on receiving such a command, starts a process for playing the selected video content.

In this case, the video reproduction section 31 reads the selected video content (video data) stored in the HDD, and supplies the read video content to the video processing section 32. The video processing section 32 performs various processes such as compressing/decompressing the supplied video content and converting it into an analog signal to form a video signal, and supplies the video signal to the display section 21 of the head-mounted display section 2. This allows the target video content to be displayed on the screen of the display section 22 of the head-mounted display section 2.

In general, the head-mounted display section 2 is held over the head with a head band. In the case where the head-mounted display section 2 is of glasses type, the head-mounted display section 2 is held over the head of the user with the so-called temples (portions of a pair of glasses that are connected to the frame and rest on the ears) hooked on the ears of the user.

However, the detection axis of the gyro sensor 22 may not extend in the vertical direction when the head-mounted display section 2 is placed over the head of the user depending on how the head-mounted display section 2 is attached to the head band.

In the case of the head-mounted display section 2 of glasses type, the detection axis of the gyro sensor 22 may not extend in the vertical direction depending on how the user wears the head-mounted display section 2.

Accordingly, the head-mounted display section 2 used in the video processing apparatus according to the second embodiment is provided with the gyro sensor 22 and the acceleration sensor 23 as shown in FIG. 6.

The gyro sensor 22 detects turning of the head of the user and may be a one-axis gyro sensor as is the gyro sensor 16 of the earphone system 1 according to the first embodiment discussed above.

The acceleration sensor 23 may be a three-axis acceleration sensor, which is provided in fixed positional relationship with the gyro sensor 22 to detect inclination of the gyro sensor 22, as is the acceleration sensor 17 of the earphone system 1 according to the first embodiment discussed above.

Also in the second embodiment, the acceleration sensor 23 is provided in the head-mounted display section 2 with one of the three detection axes of the acceleration sensor 23 (for example, Za axis) matching the detection axis of the gyro sensor 22.

A detection output from the gyro sensor 22 and a detection output from the acceleration sensor 23 provided in the head-mounted display section 2 are supplied to the user direction detection section 34 through the A/D converter 33 of the video reproduction device 3.

The A/D converter 33 converts the detection output from the gyro sensor 22 and the detection output from the acceleration sensor 23 into digital signals, and supplies the digital signals to the user direction detection section 34.

The user direction detection section 34 corrects the detection output of the gyro sensor 22 on the basis of the detection output from the acceleration sensor 23 as done by the sound image localization correction processing section 122 in the earphone system 1 according to the first embodiment illustrated in FIGS. 2 to 4.

Specifically, as illustrated in FIG. 3, the amount of deviation of the detection axis of the gyro sensor 22 from the vertical direction in the Xa-Za plane ($\cos\theta$) is first obtained from the detection outputs for the three axes of the acceleration sensor 23. Then, the amount of deviation of the detection axis of the gyro sensor 22 from the vertical direction in the Ya-Za plane ($\cos\phi$) is obtained.

Then, as illustrated in FIG. 4, the detection output of the gyro sensor 22 is corrected using the detection output of the gyro sensor 22 and the amount of deviation of the detection axis of the gyro sensor 22 from the vertical direction ($\cos\theta$, $\cos\phi$) in accordance with the formula (2) in FIG. 4. This allows obtaining the estimated output value of the gyro sensor 22 in the ideal state "Sii", in accordance with which the orientation of the head of the user is specified.

The user direction detection section 34 then supplies the video reproduction section 31 with information indicating the detected orientation of the head of the user. As discussed above, the HDD of the video reproduction section 31 stores moving image data captured for a range of 360 degrees in the horizontal direction.

The video reproduction section 31 reads a section of the moving image data in accordance with the orientation of the head of the user received from the user direction detection section 34, and reproduces the read section of the moving image data.

Figure 7:
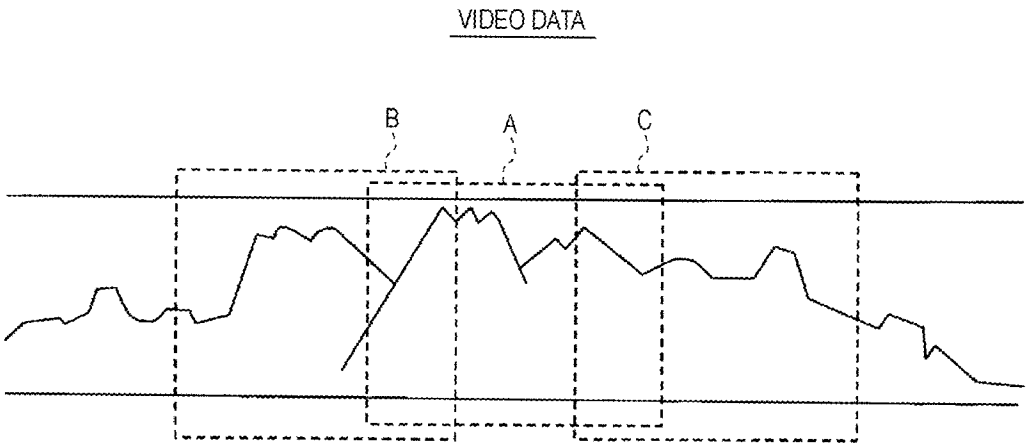
FIG. 7 illustrates a section of 360° video data to be read by a video reproduction section in accordance with the orientation of the head of a user.
Figure 8:
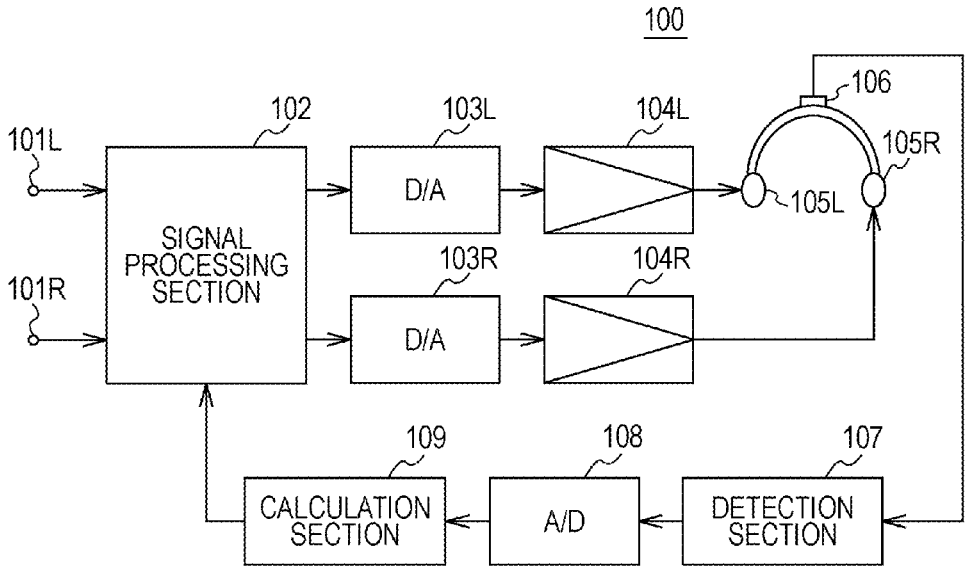
FIG. 8 illustrates an exemplary configuration of a headphone system that uses a virtual sound image localization process.
Figure 9:
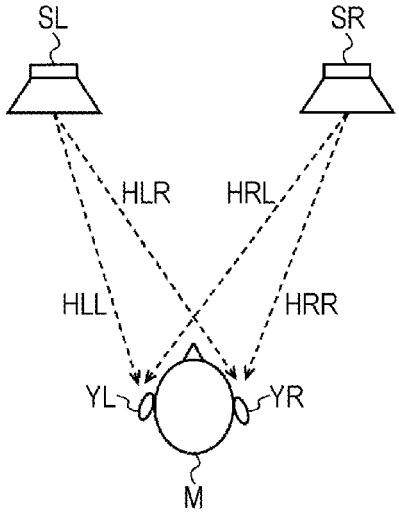
FIG. 9 illustrates the concept of the virtual sound image localization process for two channels.

FIG. 7 illustrates a section of 360° video data to be read by the video reproduction section 31 in accordance with the orientation of the head of the user. In FIG. 7, the range surrounded by the dotted line indicated by the letter A (hereinafter "display range A") corresponds to the range of the video data to be displayed when the head of the user is directed forward.

When it is detected that the head of the user is turned leftward by certain angles from the forward direction, for example, the range of the video data surrounded by the dotted line indicated by the letter B (hereinafter "display range B") in FIG. 7 is read and reproduced.

Likewise, when it is detected that the head of the user is turned rightward by certain angles from the forward direction, for example, the range of the video data surrounded by the dotted line indicated by the letter C (hereinafter "display range C") in FIG. 7 is read and reproduced.

As described above, when the user wearing the head-mounted display section 2 is directed forward, the video data in the display range A in FIG. 7 is read and reproduced. When the head of the user is turned leftward by certain angles from the forward direction, the video data in the display range B in FIG. 7 is read and reproduced. Likewise, when the head of the user is turned rightward by certain angles from the forward direction, the video data in the display range C in FIG. 7 is read and reproduced.

When the head of the user is turned further leftward while the video data in the display range B in FIG. 7 is being reproduced, a section of the video data located further to the left is read and reproduced.

Likewise, when the head of the user is turned further rightward while the video data in the display range C in FIG. 7 is being reproduced, a section of the video data located further to the right is read and reproduced.

As described above, a section of the video data captured for a range of 360 degrees and stored in the HDD is clipped and reproduced in accordance with horizontal turning of the head of the user wearing the head-mounted display section 2.

Since turning of the head of the user is obtained on the basis of the detection output of the gyro sensor 22 which has been corrected on the basis of the detection output of the acceleration sensor 23, it is possible to accurately detect the orientation of the head of the user. Consequently, it is possible to appropriately clip and reproduce a display range of the video data in accordance with the orientation of the head of the user wearing the head-mounted display section 2.

In the video processing apparatus according to the second embodiment, the video display process with consideration of turning of the head of the user is performed when a predetermined operation button switch of the video processing apparatus is operated. In this case, the position of the head of the user at the time when the predetermined operation button switch is operated is employed as the position with the head of the user directed forward (reference position).

Alternatively, the position with the head of the user directed forward (reference position) may be determined as the position of the head of the user at the time when a video playback button is operated, for example, before starting the video display process with consideration of turning of the head of the user.

Still alternatively, when it is detected that the user shakes his/her head in great motion and the motion of the head comes to a halt, the position of the head of the user at that moment may be determined as the position with the head of the user directed forward (reference position), for example, before starting the video display process with consideration of turning of the head of the user.

Various other triggers detectable by the video reproduction device may be used to start the video display process with consideration of turning of the head of the user.

[Modifications of Second Embodiment]

Although the acceleration sensor 23 is of a three-axis acceleration sensor in the head-mounted display section 2 according to the second embodiment discussed above, the present invention is not limited thereto. The acceleration sensor 23 may be of a one-axis or two-axis acceleration sensor.

For example, a one-axis acceleration sensor is initially disposed with the detection axis extending in the vertical direction. It is then possible to detect the deviation of the detection axis of the gyro sensor from the vertical direction in accordance with the differential between the actual detection value of the one-axis acceleration sensor and the value in the initial state (9.8 $m/s^2$) .

A two-axis acceleration sensor may also be used in the same way. That is, also in the case of a two-axis acceleration sensor, it is possible to detect the deviation of the detection axis of the gyro sensor from the vertical direction in accordance with the differential between the actual detection output of the acceleration sensor and the detection output obtained with the acceleration sensor disposed horizontally with respect to the floor surface.

A multiplicity or users may use an earphone system equipped with a gyro sensor and a one-axis or two-axis acceleration sensor to measure the detection output of the acceleration sensor and the amount of deviation of the detection axis of the gyro sensor in advance, preparing a table in which the resulting measurement values are correlated.

Then, the detection output of the acceleration sensor may be referenced in the table to specify the amount of deviation of the detection axis of the gyro sensor from the vertical direction, on the basis of which the detection output of the gyro sensor may be corrected.

In this case, it is necessary to store the table in which the detection output of the acceleration sensor and the amount of deviation of the detection axis of the gyro sensor from the vertical direction are correlated in a memory in the user direction detection section 34 or an accessible external memory, for example.

Although the gyro sensor 22 is a one-axis gyro sensor in the above description, the present invention is not limited thereto. It is also possible to detect turning of the head of the user in the vertical direction (up-and-down direction) using a gyro sensor with two or more axes, allowing correction of the localization of a sound image in the vertical direction as well.

In the second embodiment, as is clear from the above description, the head-mounted display section 2 implements the function as display means, the gyro sensor 22 implements the function as turning detection means, and the acceleration sensor 23 implements the function as inclination detection means. In addition, the user direction detection section 34 implements the function as turning correction means and the video reproduction section 31 implements the function as video processing means.

The video processing apparatus according to the second embodiment illustrated mainly in FIGS. 5 to 7 is applied with a video processing method according to the present invention. That is, the video processing method according to the present invention includes the steps of: (A) detecting turning of the head of the user wearing the head-mounted display section 2 through the gyro sensor 22 provided in the head-mounted display section 2; (B) detecting inclination of the gyro sensor 22 through the acceleration sensor 23 provided in the head-mounted display section 2; (C) correcting detection results for the turning of the head of the user detected by the gyro sensor 22 on the basis of the inclination of the gyro sensor 22 detected by the acceleration sensor 23; and (D) causing the video reproduction section 31 to clip a section of video data from the video data for a range of 360 degrees in the horizontal direction, for example, stored in the HDD in accordance with the turning of the head of the user on the basis of the corrected detection results for the turning of the head of the user detected by the gyro sensor 22, and to supply the clipped section of the video data to the head-mounted display section 2.

<Other Embodiments>

In the above first embodiment, the earphone system 1 to which the sound processing apparatus according to the present invention is applied is described. In the above second embodiment, the head-mounted display section 2 to which the video processing apparatus according to the present invention is applied is described.

However, the present invention is not limited thereto. The present invention may be applied to a sound/video processing apparatus including a sound reproduction system and a video reproduction system. In this case, a gyro sensor and an acceleration sensor may be provided in one of earphones or a head-mounted display section. A detection output of the gyro sensor is corrected on the basis of a detection output of the acceleration sensor.

Then, the corrected detection output from the gyro sensor is used to control a sound image localization process performed by a sound image localization processing section and the display range (read range) of video data displayed by a video reproduction device.

This allows both a virtual sound image localization process and a video clipping range control process to be performed appropriately with a single gyro sensor and a single acceleration sensor.

The present application contains subject matter related to that disclosed in Japanese Priority Patent Application JP 2008-216120 filed in the Japan Patent Office on Aug. 26, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A sound processing apparatus comprising:

sound image localization processing means for performing a sound image localization process on a sound signal to be reproduced in accordance with a predefined head-related transfer function;

a speaker section placeable over an ear of a user and supplied with the sound signal which has been subjected to the sound image localization process by the sound image localization processing means to emit sound in accordance with the sound signal;

a gyro sensor provided in the speaker section to detect turning of a head of the user wearing the speaker section;

an acceleration sensor provided in the speaker section to detect inclination of the gyro sensor;

turning correction means for correcting detection results from the gyro sensor on the basis of detection results of the acceleration sensor, wherein the corrected detection results are an estimate of detection results that would have resulted if a detection axis of the gyro sensor was oriented in a vertical direction; and adjustment means for controlling the sound image localization processing means so as to adjust a localized position of a sound image on the basis of the corrected detection results.

2. The sound processing apparatus according to claim 1, wherein the acceleration sensor is an N-axis acceleration sensor, where N is an integer greater than or equal to 1.

3. The sound processing apparatus according to claim 1, wherein the speaker section is one of in-ear type, intra-concha type, and ear-hook type.

4. The sound processing apparatus according to claim 1, wherein the gyro sensor is a single axis gyro sensor.

5. The sound processing apparatus according to claim 1, wherein a reference position is determined at a time when a button is operated.

6. The sound processing apparatus according to claim 1, wherein a reference position is determined at a time when the user's head comes to a halt after the user's head is shaken.

7. A sound image localized position adjustment method comprising:

detecting turning of a head of a user using a gyro sensor provided in a speaker section placed over an ear of the user;

detecting inclination of the gyro sensor through an acceleration sensor provided in the speaker section;

correcting detection results for the turning of the head of the user detected in the turning detection step on the basis of the inclination of the gyro sensor detected in the inclination detecting, wherein the corrected detection results are an estimate of detection results that would have resulted if a detection axis of the gyro sensor was oriented in a vertical direction; and controlling a sound image localization process to be performed on a sound signal to be reproduced so as to adjust a localized position of a sound image on the basis of the corrected detection results for the turning of the head of the user.

8. The sound image localized position adjustment method according to claim 7, wherein the acceleration sensor used in the inclination detecting is an N-axis acceleration sensor, where N is an integer greater than or equal to 1.

9. The sound image localized position adjustment method according to claim 7, wherein the speaker section placed over the ear of the user is one of in-ear type, intra-concha type, and ear-hook type.

10. A video processing apparatus comprising:

display means mountable over a head of a user;

a gyro sensor provided in the display means to detect turning of the head of the user wearing the display means;

an acceleration sensor provided in the display means to detect inclination of the gyro sensor;

turning correction means for correcting detection results from the gyro sensor on the basis of detection results of the acceleration sensor, wherein the corrected detection results are an estimate of detection results that would have resulted if a detection axis of the gyro sensor was oriented in a vertical direction; and video processing means for clipping a section of video data from a range of video data wider than a human viewing angle in accordance with the turning of the head of the user on the basis of the corrected detection results.

11. The video processing apparatus according to claim 10, wherein the acceleration sensor is an N-axis acceleration sensor, where N is an integer greater than or equal to 1.

12. The video processing apparatus according to claim 10, wherein the gyro sensor is a single axis gyro sensor.

13. The video processing apparatus according to claim 10, wherein a reference position is determined at a time when a button is operated.

14. The video processing apparatus according to claim 10, wherein a reference position is determined at a time when the user's head comes to a halt after the user's head is shaken.

15. A video processing method comprising:

detecting turning of a head of a user through a gyro sensor provided in display means placed over the head of the user;

detecting inclination of the gyro sensor through an acceleration sensor provided in the display means;

correcting detection results for the turning of the head of the user detected in the turning detection step on the basis of the inclination of the gyro sensor detected in the inclination detecting, wherein the corrected detection results are an estimate of detection results that would have resulted if a detection axis of the gyro sensor was oriented in a vertical direction; and causing video processing means to clip a section of video data from a range of video data wider than a human viewing angle in accordance with the turning of the head of the user on the basis of the corrected detection results for the turning of the head of the user and to supply the clipped section of the video data to the display means.

16. The video processing method according to claim 15, wherein the acceleration sensor is an N-axis acceleration sensor, where N is an integer greater than or equal to 1.

17. A sound processing apparatus comprising:

a sound image localization processing section configured to perform a sound image localization process on a sound signal to be reproduced in accordance with a predefined head-related transfer function;

a speaker section placeable over an ear of a user and supplied with the sound signal which has been subjected to the sound image localization process by the sound image localization processing section to emit sound in accordance with the sound signal;

a gyro sensor provided in the speaker section to detect turning of a head of the user wearing the speaker section;

an acceleration sensor provided in the speaker section to detect inclination of the gyro sensor;

a turning correction section configured to correct detection results from the gyro sensor on the basis of detection results of the acceleration sensor, wherein the corrected detection results are an estimate of detection results that would have resulted if a detection axis of the gyro sensor was oriented in a vertical direction; and an adjustment section configured to control the sound image localization processing section so as to adjust a localized position of a sound image on the basis of the corrected detection results.

18. A video processing apparatus comprising:

a display section mountable over a head of a user;

a gyro sensor provided in the display section to detect turning of the head of the user wearing the display section;

an acceleration sensor provided in the display section to detect inclination of the gyro sensor;

a turning correction section configured to correct detection results from the gyro sensor on the basis of detection results of the acceleration sensor, wherein the corrected detection results are an estimate of detection results that would have resulted if a detection axis of the gyro sensor was oriented in a vertical direction; and a video processing section configured to clip a section of video data from a range of video data wider than a human viewing angle in accordance with the turning of the head of the user on the basis of the corrected detection results.

* * * * *